United States Patent [19]

Wooten et al.

[11] Patent Number: 4,794,503

[45] Date of Patent: Dec. 27, 1988

[54] LAMP HAVING IMPROVED IMAGE RESOLUTION

[75] Inventors: Robert D. Wooten, Rockville; Robert J. Sweetman, Olney; Andrew D. P. Harbourne, Ijamsville; Michael G. Ury, Bethesda, all of Md.

[73] Assignee: Fusion Systems Corporation, Rockville, Md.

[21] Appl. No.: 100,064

[22] Filed: Sep. 23, 1987

[51] Int. Cl.[4] ..... F21V 7/12

[52] U.S. Cl. ..... 362/346; 362/297; 362/347; 362/348; 362/349; 362/16

[58] Field of Search ..... 362/16, 346, 347, 348, 362/349, 350, 297

[56] References Cited

U.S. PATENT DOCUMENTS

| | | | |
|---|---|---|---|
| 2,341,658 | 2/1944 | Salini . | |
| 2,771,001 | 11/1956 | Gretener | 350/630 |
| 2,846,565 | 8/1958 | Binkley et al. | 362/350 |
| 3,492,474 | 1/1970 | Yamaguchi et al. | 362/350 |
| 3,645,606 | 2/1972 | LaVantine | 350/613 |
| 4,153,929 | 5/1979 | Laudenschlarger et al. | 362/350 |
| 4,545,000 | 10/1985 | Fraley et al. | 362/297 |
| 4,683,525 | 7/1987 | Camm | 362/297 |

*Primary Examiner*—Michael Koczo
*Assistant Examiner*—Sue Hagarman
*Attorney, Agent, or Firm*—Pollock, Vande Sande & Priddy

[57] ABSTRACT

A lamp including a reflector and a light source for illuminating a target area in which the light rays on the target and have a small average local divergence. The reflector and light source are configured so that the predominant portion of the light rays which strike the target area do not cross the axis of the reflector. The reflector may be segmented and the light source is located so that various points on the target receive radiation which is reflected from a different number of segments with points near the periphery of the target area receiving radiation from a greater number of segments than those near the center of the target.

9 Claims, 4 Drawing Sheets

LAMP HAVING IMPROVED IMAGE RESOLUTION

This invention relates to lamps for irradiating targets and is directed to a lamp for providing radiation at a target plane in which non-uniformaties or discontinuities in the source and/or the reflector are averaged out across the target plane and in which the radiation has a relatively small average local divergence and substantial collimation.

BACKGROUND OF THE INVENTION

Many applications for optical equipment require relatively uniform radiation across the extent of a target plane. For example, in photolithography, light is projected from a lamp through a mask or transparency at a target plane, behind which a photosensitive medium is disposed. It may be desirable for the projected light to be uniform so that the areas of varying transparency of the mask are truly recorded on the photosensitive medium. Non-uniformities or discontinuities in the light source and/or the reflector can result in poor imaging.

It is also desirable for the radiation at the target plane to be of small local divergence, where local divergence is defined as the solid angle subtended by the source, as seen from points on the target.

It may also be desirable for the radiation which is projected on the target area to be collimated or substantially collimated.

In some prior art photolithography systems, as shown in Japanese laid open Patent Application No. 58-35861, refractive optics are employed to attempt to make the projected light uniform. However, such systems do not have a small local divergence, as the divergence of such systems measured at the center of the target plane is approximately the same relatively large angle as the divergence at the edge of the target. Accordingly, such prior art systems may not achieve the desired resolution at the photosensitive medium.

U.S. Pat. No. 4,683,525 to Camm and assigned to Fusion Systems Corporation, describes a lamp which has a reflector capable of providing the combination of a substantially uniform light flux and a small average local divergence over the target area. However, a lamp which, in addition, provides improved collimation is desired.

SUMMARY OF THE INVENTION

It is thus an object of the present invention to provide a lamp which projects radiation at a target plane in which non-uniformities or discontinuities in the source and/or reflector are averaged out across the target plane.

It is still another object of the invention to provide a lamp which projects light having a relatively small local divergence on a target plane.

It is yet another object of this invention to provide a lamp emitting radiation which is substantially collimated.

Another object of the invention is provide a lamp having an improved image resolution through the use of small average local divergence and better collimation.

It is still a further object of the invention to provide a lamp which attains the foregoing objects using an electrodeless light source.

In accordance with the invention a lamp is provided which has a specular reflector and a light source disposed in the reflector for illuminating a target. The reflector is configured with respect to the light source and the target area so that (1) points on the target receive radiation which is reflected from a plurality of different points on the reflector, (2) the average local divergence of the radiation illuminating the target is minimized, and (3) the radiation illuminating the target is substantially collimated. These results are achieved in the embodiments of the invention described herein by a reflector configuration in which substantially all radiation reflected from one side of the reflector illuminates the corresponding side of the target, and in which the largest area of the target is illuminated by the largest area of the reflector. The combination of substantial collimation and minimum average local divergence of radiation increases the clarity of projected images in photolithography processes. The illumination of points on the target by a plurality of different points on the reflectors averages out non-uniformities in both the light source and the reflector.

In the preferred embodiment of this invention, the reflector is segmented, and the segments, or facets, are arranged with respect to the light source and the target plane so that points on the target plane, other than at or near the center, receive radiation which is reflected by two or more different facets of the reflector.

By orientation of the facets, a high degree of uniformity of illumination across the target can be achieved, or if desired the extent of illumination of the target can be varied across the target. A variation in the illumination across the target may be desirable, for example, in using photographic media that vary in response according to the angle of incidence of the radiation on the target plane, or that vary in response to the radial position in the target plane.

DESCRIPTION OF THE PREFERRED EMBODIMENT

Figure 1:
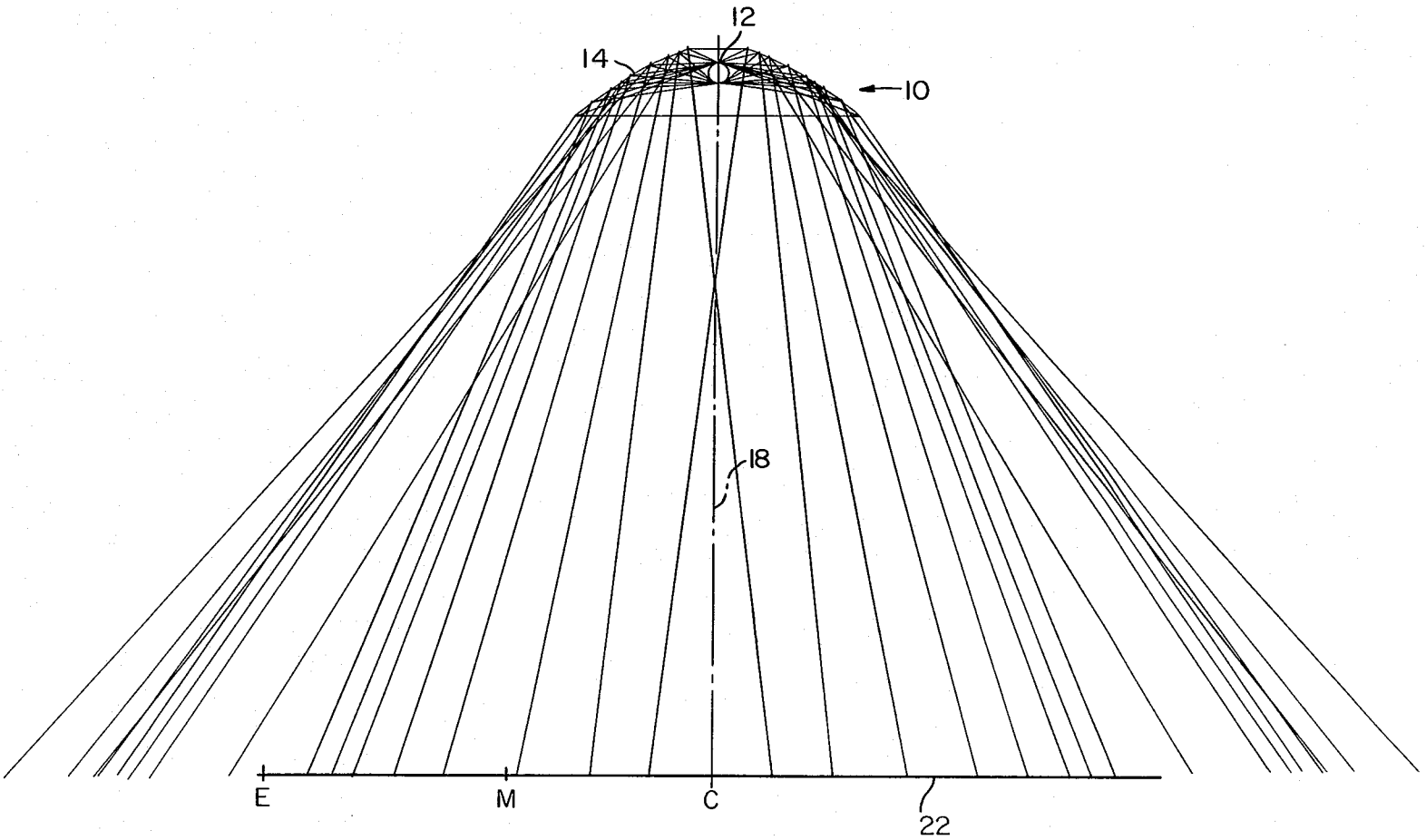
FIG. 1 is a schematic illustration of an embodiment of the lamp of the invention including a ray diagram which illustrates the orientation of the rays with respect to the axis of the specular reflector.
Figure 2:
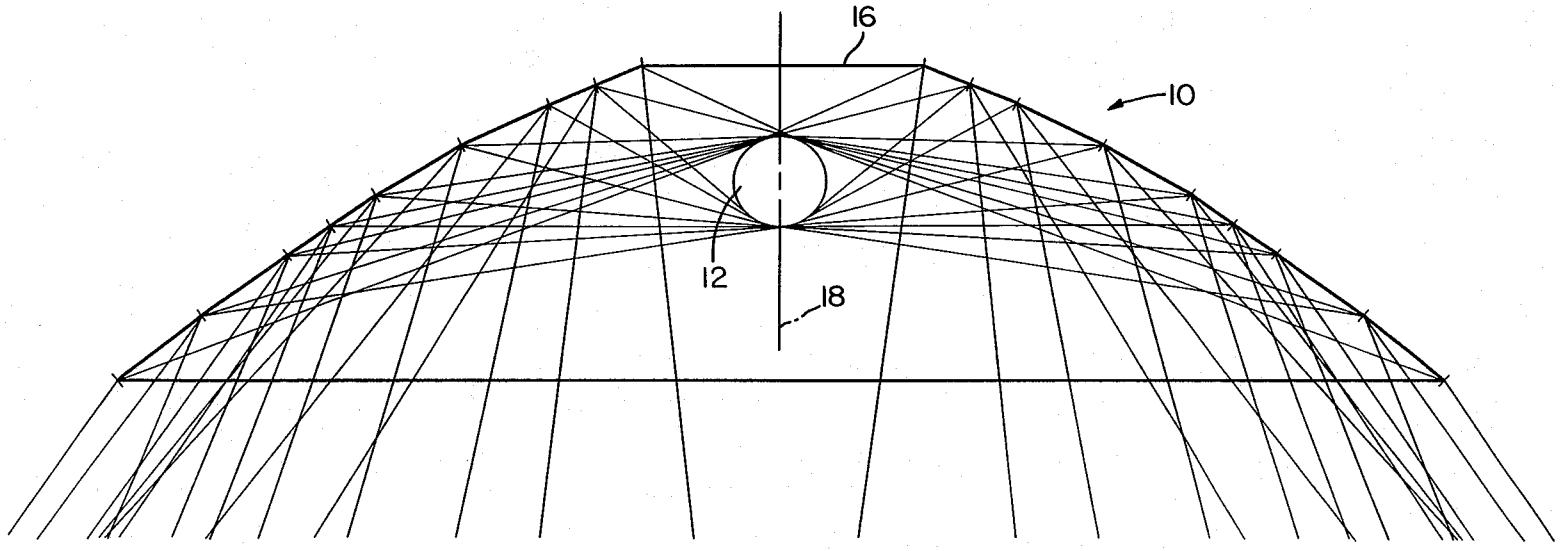
FIG. 2 is an enlargement of the lamp of FIG. 1.
Figure 3:
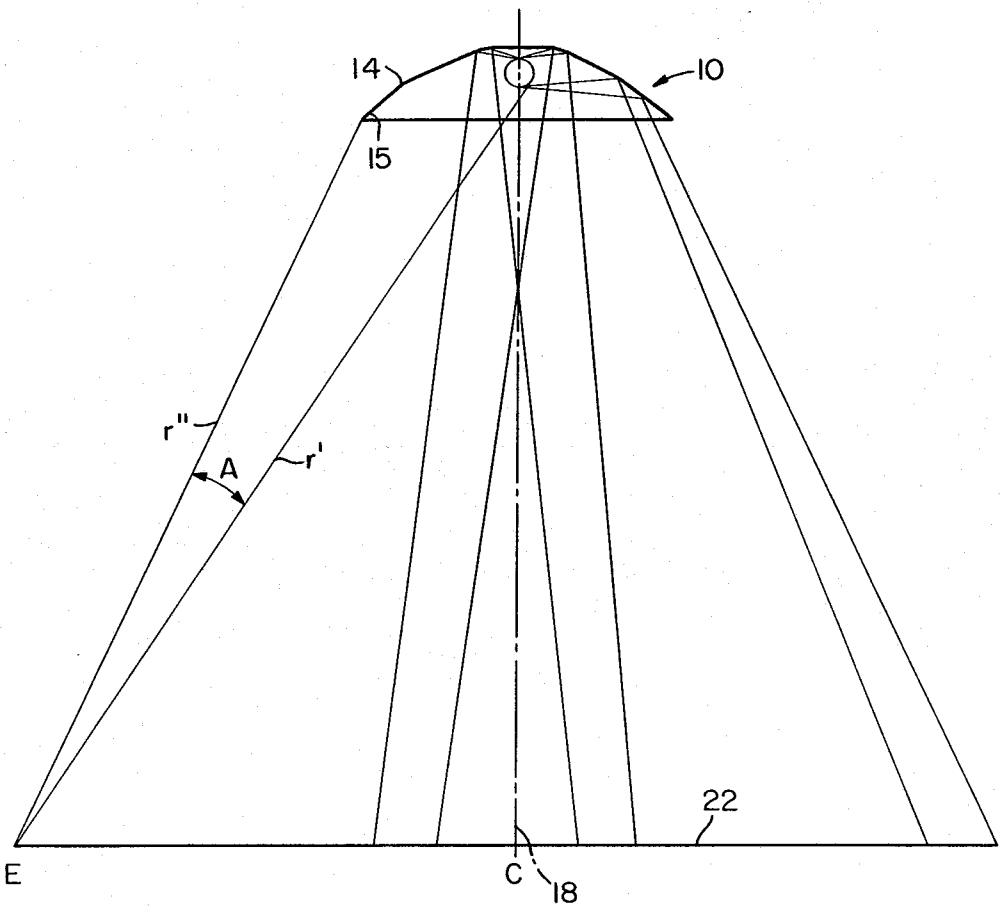
FIG. 3 is a schematic of the invention illustrating the concept of local divergence.

Referring to FIGS. 1–3, lamp 10 is comprised of light source 12 and specular reflector 14. In the embodiment of these figures, light source 12 is spherical in shape, although other shapes may be used.

The reflective surface of reflector 14 may be defined by a continuous surface or by facets in which there is a discontinuity between facets. A continuous surface has the advantage that it may provide a lower average local divergence; however, for practical reasons, a faceted reflector is often used. Such a reflector is easier to design and manufacture, and the light source can be located with respect to the reflective surface so that most points on the target area "see" the light source in at least two facets. The latter point is important in achieving uniformity of radiation on the target area when the light source or the reflective surface are not uniform.

As can be seen in the figures, the configuration of the reflector and the positioning of the light source with respect to the reflector results in the predominant portion from which it originates, i.e., there is little radiation that crosses from one side of the axis to the other. This feature results in substantial collimation of the radiation which is not achieved with a reflector configured so that the predominant portion of the radiation crosses the axis. Furthermore, the rays which remain on one side of the axis are more nearly vertical than those which cross the axis and this tends to improve the clarity of images. However, an increase in collimation, which can be achieved by increasing the size of the reflector, also results in an increase in the average local divergence which has the counterbalancing effect of reducing the clarity of images. In the preferred embodiment of this invention a balance has been struck between these two effects and for a given extent of collimation the average local divergence of radiation is minimized.

In a typical application using the lamp of this invention, the diameter of the reflector will be from about $\frac{1}{4}$ to about $\frac{1}{2}$ the largest dimension of the illuminated portion of the target, and a diameter of about $\frac{1}{3}$ of the largest target dimension is highly suitable.

Center 16 of the reflector is open or is otherwise non-reflective due to the microwave coupling elements; consequently, if all radiation were to be retained on that side of the axis from which it originates, the only radiation which the area at C would receive would be directed from the light source. In order to provide sufficient illumination at the center C of the target the rays from one facet, and preferably the innermost facet (facet 1 in FIG. 5) must cross the axis. Preferably, the amount of radiation which crosses the axis is limited to that which is required to illuminate the center to the same extent as the illumination on the rest of the target. The percent of total radiation striking the target which thus crosses the axis is very small since only a very small amount of radiation is required to illuminate the center portion of the target which has a very small area.

The collimation achieved by the lamp of this invention is illustrated by FIGS. 1 and 3 in which the center of the target is marked with the letter C and the edge of the target by the letter E. The letter M denotes a portion of the target intermediate between its center and its edge. As is evident, rays which are near each other are substantially parallel, and thus various points on the target are illuminated by radiation which is substantially collimated.

U.S. Pat. No. 4,683,525 to Camm, cited above, is directed to a lamp which provides a minimum average local divergence of radiation, and the teachings of Camm are hereby incorporated in this disclosure. However, a brief description of "local divergence" follows in order to provide a better understanding of this invention.

As seen in FIG. 3, point E is irradiated with rays r′ emitted from the right hand side of light source 12 and ray r″ emitted from the edge 15 of reflector 14, as well as with rays reflected from other portions of the reflector between light source 12 and edge 15. The angle A between the two rays r′ and r″ is the worst case "local angle of divergence" which is minimized, taking into account the collimation which has been achieved. The mean "local angle of divergence" which is the average of the rays striking the target is, of course, less.

The reflector may be formed by methods conventional in the metal working art, such as by spinning or pressing a sheet of metal, or welding together annular segments, or machining or electroforming bulk metal to the desired shape.

Figure 4:
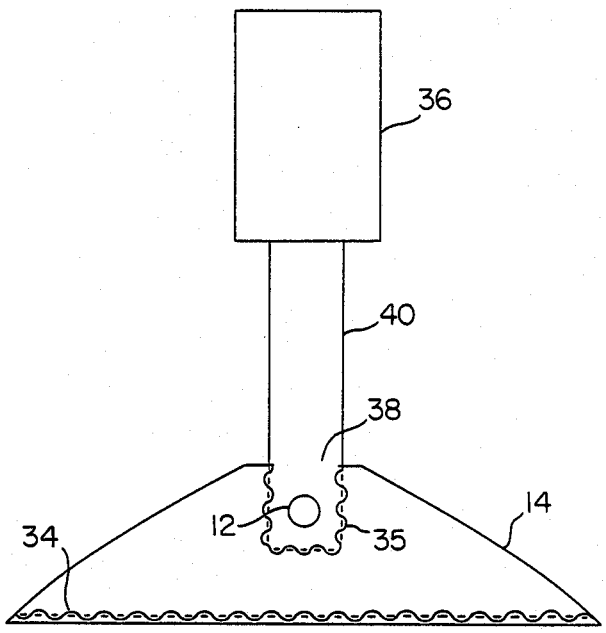
FIG. 4 is an illustration of a preferred embodiment of the specular reflector of the invention utilizing an electrodeless light source.

FIG. 4 is an illustration of a microwave energized electrodeless lamp which utilizes the present invention. Referring to FIG. 4, light source 12 and reflector 14 are as shown in FIGS. 1 and 2. Mesh 35 surrounds light source 12 to contain microwave energy in the vicinity of the light source and allow radiation used for imaging to exit. Additionally, mesh 34 is disposed across the reflector. Microwave energy is generated by magnetron 36 and is fed to slot 38 in the reflector wall by waveguide 40.

Figure 5:
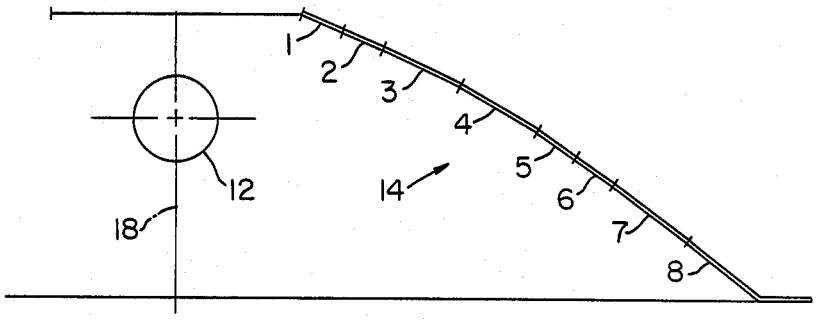
FIG. 5 is a detail of a preferred embodiment of the invention.

FIG. 5 is a detailed illustration of the reflector which shows the dimensions for the annular facets 1–8. Each facet comprises an annular band around axis 18 forming a reflector which is rotationally symmetrical. The reflective inner surfaces of facets 1–8 are surfaces of revolution generated by rotating straight line segments about the reflector axis.

The specific embodiment shown in FIG. 5, which has a reflector diameter of about 40 cm. achieves excellent image clarity with a target area of about 130 cm. in diameter and at a target distance from the light source of about 100 cm.

While the illustrative embodiment has been disclosed in connection with facets, which may be either flat or curved, it is to be understood that a continuous curved surface could also be used.

It is to be understood that while an illustrative embodiment of the invention utilizing a rotationally symmetrical reflector has been described above, other possible configurations will occur to those in the art, and the scope of the invention is to be limited only by the claims appended hereto and equivalents.

What is claimed is:

1. A lamp for providing substantial collimation of radiation and a small average local divergence of radiation over the extent of a target of variable transparency to be illuminated comprising:

a light source for emitting radiation; and a reflector in which said light source is disposed, said reflector having an axis and a reflective surface which is symmetrical with respect to said axis and which is configured with respect to said source and the area of said target to be illuminated such that most points on said target receive radiation which is reflected from a plurality of different points on said reflector, with points on the target which are closer to the periphery thereof receiving radiation which is reflected from a greater area of the reflector than are points which are closer to the center of the target in such a manner that non-uniformities or discontinuities in said light source or said reflector are averaged across the entire target area, and the average local divergence of the radiation is minimized, said reflector further being configured so that a predominant portion of said radiation reflected from one side of the reflector illuminates the corresponding side of the target, thereby substantially collimating the radiation received across the target.

2. The lamp in accordance with claim 1 wherein the reflector comprises a plurality of annular reflecting facets.

3. The lamp in accordance with claim 2 wherein substantially the only radiation which crosses the opposite side of said target is reflected from only one facet.

4. The lamp in accordance with claim 2 wherein substantially the only radiation which crosses the reflector axis from one side of said reflector to the opposite side of said target is reflected from the innermost facet.

5. The lamp in accordance with claim 2 wherein the reflector is configured so that the area near the perimeter of said target is illuminated by the outermost facets of said reflector.

6. The lamp in accordance with claim 5 wherein target points which are near the periphery of said target are illuminated by radiation from a plurality of facets.

7. The lamp in accordance with claim 2 wherein said annular facets are surfaces of revolution generated by rotating straight line segments about said axis.

8. The lamp in accordance with claim 1 wherein said light source is substantially spherical in shape.

9. The lamp in accordance with claim 1 wherein said light source is a volume emitter of radiation.

* * * * *